United States Patent [19]

Schumacher, Jr.

[11] 4,446,935

[45] May 8, 1984

[54] INTERMITTENT HIGH-DRAG OIL WELL DRILLING BIT

[75] Inventor: Percy W. Schumacher, Jr., Houston, Tex.

[73] Assignee: Reed Tool Company (Delaware), Houston, Tex.

[21] Appl. No.: 420,417

[22] Filed: Sep. 20, 1982

Related U.S. Application Data

[63] Continuation of Ser. No. 24,844, Mar. 28, 1979, abandoned.

[51] Int. Cl.[3] ..... E21B 4/02; E21B 10/56

[52] U.S. Cl. ..... 175/329; 175/106; 175/338

[58] Field of Search ..... 175/104–107, 175/329, 343, 319, 338

[56] References Cited

U.S. PATENT DOCUMENTS

| | | | |
|---|---|---|---|
| 1,391,626 | 9/1921 | Gilthorpe | 175/106 |
| 1,419,068 | 6/1922 | McFadden | 175/104 |
| 2,121,202 | 6/1938 | Kilgore | 175/374 |
| 2,336,336 | 12/1943 | Zublin | 175/107 |
| 2,481,009 | 9/1949 | Gill | 175/104 |
| 2,704,204 | 3/1955 | Koontz | 175/374 |
| 2,709,574 | 5/1955 | Arutunoff | 175/107 |
| 2,898,087 | 8/1959 | Clark | 175/107 |
| 3,429,390 | 2/1969 | Bennett | 175/343 |
| 4,148,368 | 4/1979 | Evans | 175/329 |
| 4,203,496 | 5/1980 | Baker et al. | 175/374 |

FOREIGN PATENT DOCUMENTS

| | | | |
|---|---|---|---|
| 636363 | 12/1978 | U.S.S.R. | 175/106 |

*Primary Examiner*—Ernest R. Purser
*Attorney, Agent, or Firm*—Carl Rowold

[57] ABSTRACT

Methods and apparatus are disclosed for the rapid and efficient drilling of oil well and other types of bore holes through tough abrasive underground formations, which methods and apparatus utilize high drag intermittent contact and cooling techniques to provide good rates of penetration with low wear and heat deterioration on the drilling tools.

7 Claims, 10 Drawing Figures

FIG. 3
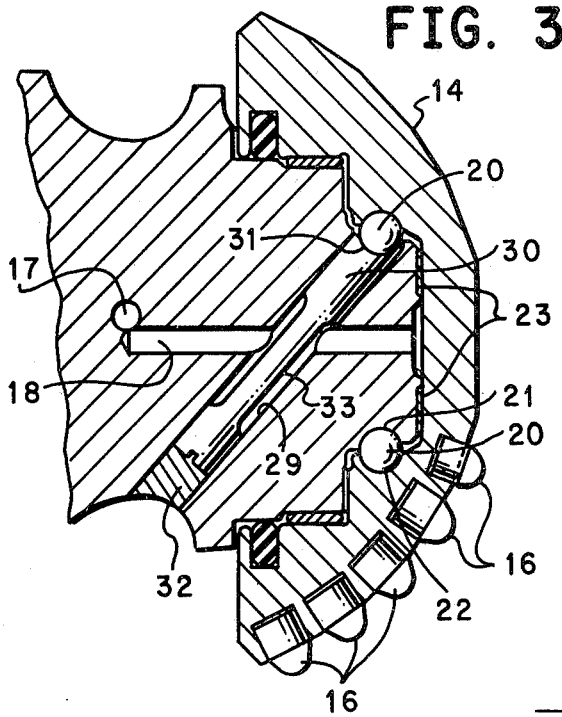
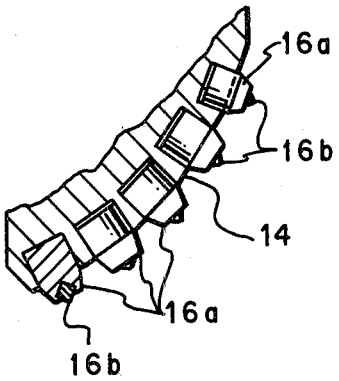
FIG. 3A
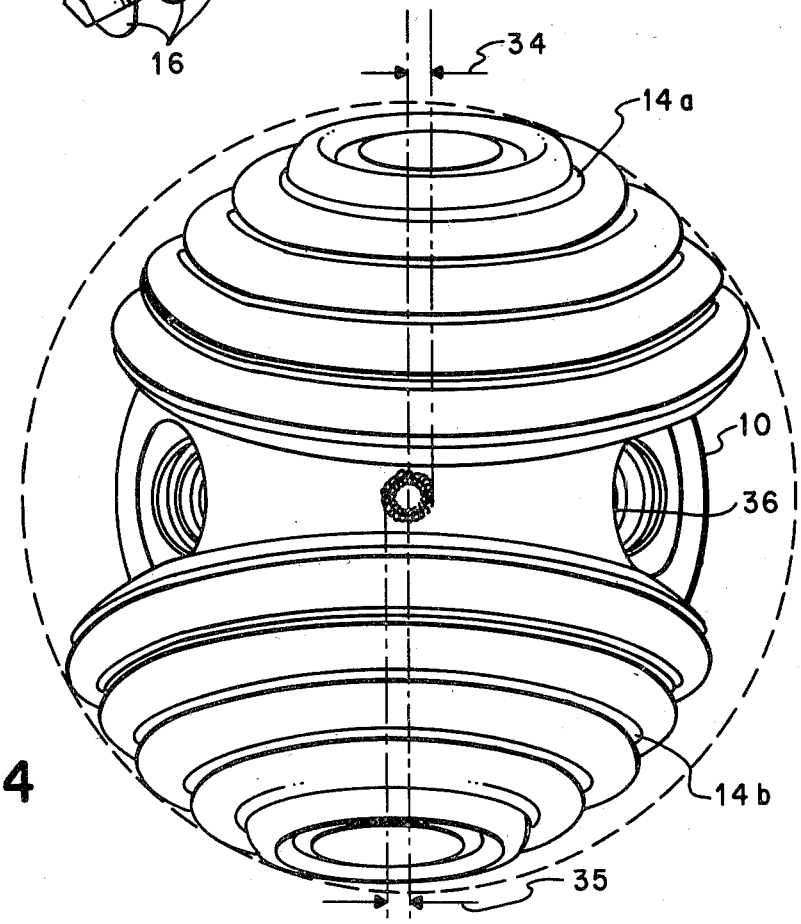
FIG. 4

INTERMITTENT HIGH-DRAG OIL WELL DRILLING BIT

This is a continuation of application Ser. No. 024,844, filed Mar. 28, 1979, now abandoned.

BACKGROUND OF THE INVENTION

This application is related to the drilling of underground formations containing highly abrasive materials and is more particularly directed to methods and apparatus for drilling through abrasive formations utilizing high drag and intermittent contact techniques.

There are many known drilling tools utilized in the prior art for penetrating underground formations with drilled bore holes. Many of these prior art devices utilize a tricone rolling cutter drill bit having three conical cutter heads rotatably mounted on journal bearing shafts. Another type of drilling device commonly utilized in this field is the diamond type of bit which utilizes the single drilling head formed of a single integrated body which drilling head contains cutting elements and is rotated against the formation being cut. The diamond type bit normally maintains full drilling contact with the formation at all times during the drilling operation. The rolling cutter drill bit normally maintains full or nearly full surface contact between the three rolling cutter lower edges and the bottom of the bore hole. Normally the tricone bit utilizes very little drag and in many instances is defined as a "rolling cone" bit.

The problems arising from these two types of drilling bits depend upon the principle involved in the drilling operation. In a highly abrasive formation the diamond type bit which utilizes either natural or synthetic diamond cutting elements located in the single integral head structure is that the drilling head and the cutting elements maintain constant contact with the abrasive formation at all times during the drilling operation. Because of the highly abrasive nature of certain formations, a large amount of heat buildup occurs in the cutting elements. Because of the high conductivity of the diamond portion of the cutting element and the lower conductivity of the carbide mounting in the element and also the low conductivity of the carbide-diamond interface, the heat generated by drilling in the abrasive formations is trapped in the diamond cutting element and serves to rapidly deteriorate the element. Because of this heat buildup the life of diamond cutting elements in these type formations is severely restricted. In addition, the constant contact of the cutting elements causes formation material to build up at the diamond-formation interface, impeding the cutting action of the cutting elements. Attempts to alleviate these problems have been directed toward providing extremely high velocity drilling fluid past the cutting elements to cool and clean the elements. This requires a high hydraulic input of a drilling fluid into the drilling area which requires a great amount of horsepower and which can result in erosion of the exposed portions of the drilling system.

Although the rolling cutter drill bit utilizes intermittent contact drilling elements it suffers in many tough formations in that the rate of penetration is drastically reduced. To obtain an acceptable rate of penetration, the drilling bit necessarily requires a relatively high amount of drag between the cutting elements and the formation being drilled. A rolling cutter drill bit, rather than shearing the material from the rock face, generally performs the function of rock removal by compressive forces. This, while sufficient in brittle formations, does not give a good rate of penetration in extremely tough formations. Thus the rolling cutter drill bit normally does not provide sufficient drag to give an acceptable rate of penetration in the tough formations.

The present invention overcomes the disadvantages and deficiencies of the prior art devices by providing methods and apparatus for drilling abrasive formations utilizing high drag intermittent contact drilling bits.

BRIEF DESCRIPTION OF THE DRAWINGS

FIG. 3 is a partial cross-sectional view of the rotating cutter and cutter elements of the bit of FIGS. 1 and 2.

FIG. 3*a* is an alternate cutting element design for the cutter element of FIG. 3.

FIG. 4 is an axial end view of the rotating cutter drag bit.

DESCRIPTION OF THE PREFERRED EMBODIMENTS

Figure 1:
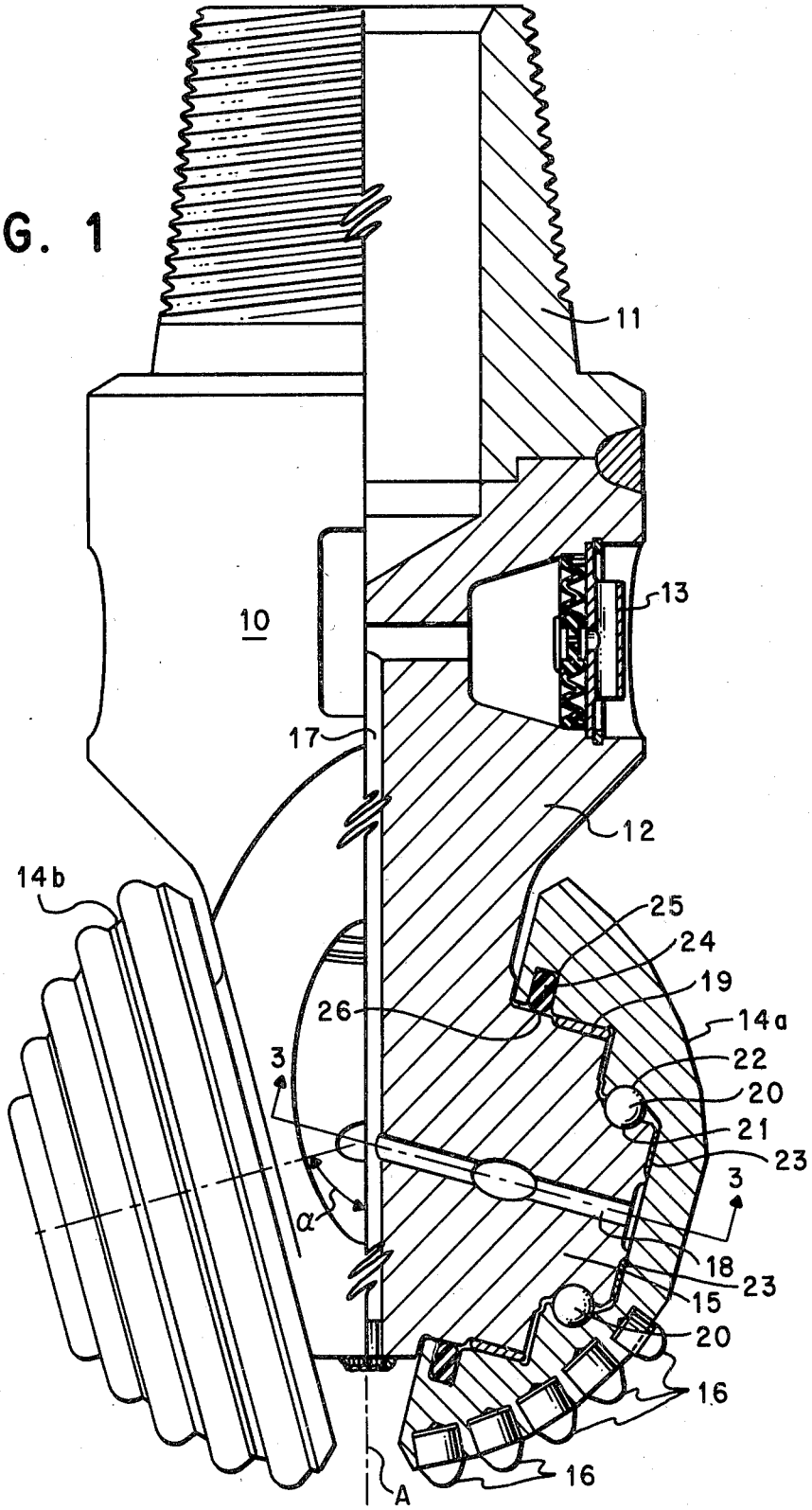
FIG. 1 is a partial sectional side view of a rotating cutter drag bit utilizing the present invention.

Referring now to FIG. 1 a two-cutter drag bit 10 is illustrated in partial cross section and comprises an upper threaded pin connection 11, a generally tubular body section 12 having a grease reservoir 13 therein, and a pair of large generally frustoconical shaped cutters 14*a* and 14*b*. The cutters 14 are rotatably mounted on large bearing shafts 15 which are formed on the lower end of body section 12 and extend downwards and outwards at an angle $\alpha$ with the vertical axis A—A of the drill bit. Each cutter 14 comprises multiple rows of hard metal cutter elements 16 commonly termed inserts or compacts. The cutter elements 16 are embedded in circumferential rows in the outer wall of frustoconical cutters 14. A lubricant passage 17 extends from reservoir 13 down through the center of body section 12 and intersects a pair of bearing lubricant passages 18 passing through the central region of the two bearing shafts 15.

Each cutter is rotatably mounted on the cylindrical bearing shafts 15 and a cylindrical flat bearing bushing 19 is located between the cutters and the bearing shaft to provide the bearing surface for receiving the axial loads on the cutters during the drilling operations. A set of ball bearings 20 are located in bearing races 21 and 22 which are formed in the bearing shaft 15 and cutter 14 respectively. Bearings 20 are inserted through a bearing access channel not shown. The placement of bearings 20 in grooves 21 and 22 serves to retain the cutter 14 on the shaft 15 and to absorb partially the thrust loading on the cutters. In addition to the load carrying capacity of ball bearings 20, an additional thrust bearing face 23 is provided at the end of shaft 15 for bearing contact with the inner wall of cutter 14. An elastomeric radial seal element 24 is located in relatively tight-fitting engagement in a circular groove 25 to provide sealing contact with a polished seal land 26 on shaft 15. Seal 25 serves as a grease retention seal and also is a barrier to prevent detritus and abrasive and corrosive particles from reaching the bearings 19, 20 and 23.

Figure 2:
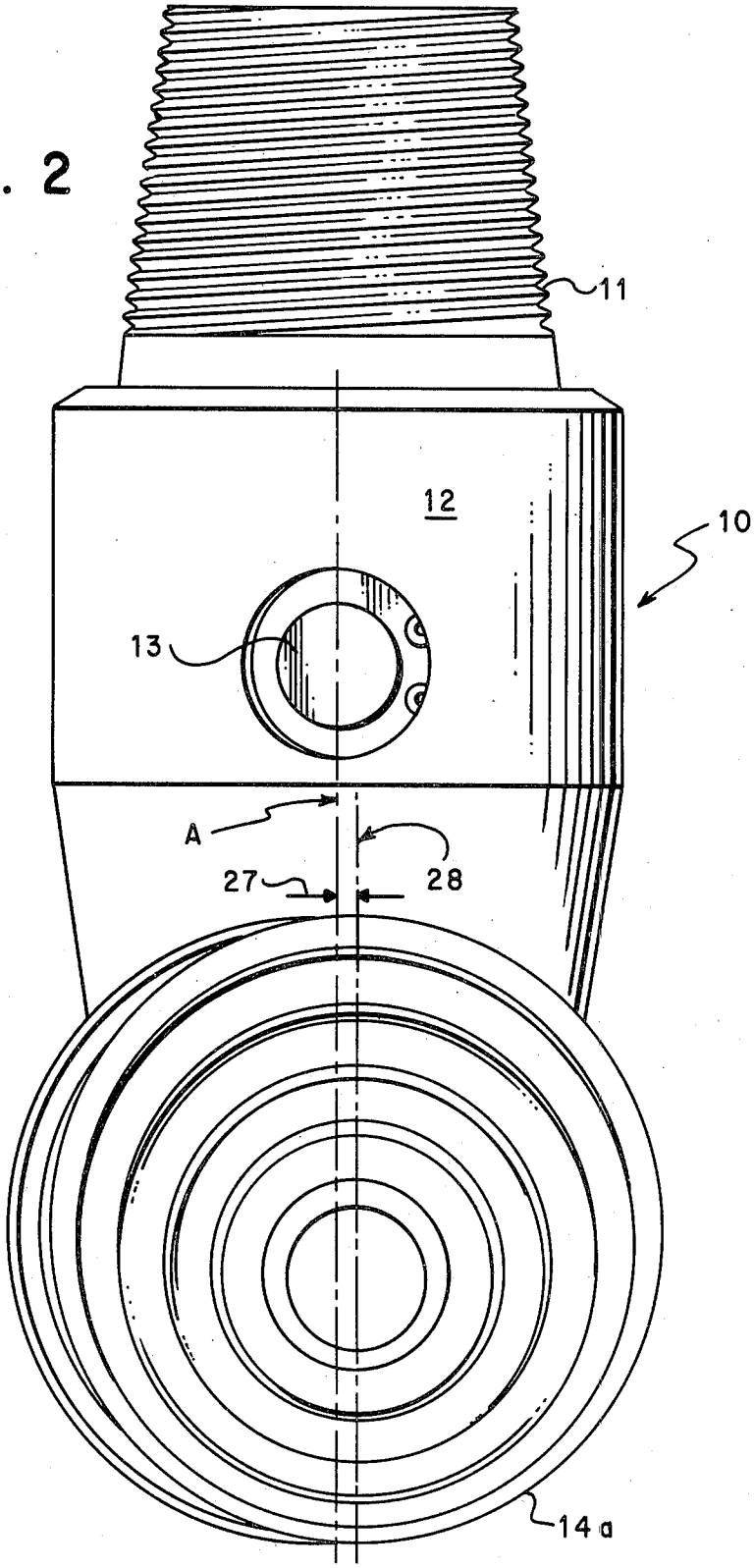
FIG. 2 is a side view of the bit of FIG. 1 taken at a 90° angle therefrom.

Referring to FIG. 2, a side elevation view of the bit of FIG. 1 is illustrated showing the offset of the center lines designated at 27 in the Figure. The cutter center line 28 is offset from the bit center line A—A.

FIG. 3 is a partial cross-sectional view of the two cutters 14 illustrating the method of placing the ball bearings 20 and their complementary bearing races 21 and 22. In this illustration the bearings 20 are loaded through a bearing channel 29 until a full circle of bearings is located between races 21 and 22. An elongated bearing retention lug 30 is then inserted into channel 29 until the curved end face 31 matches the curvature of the bearing race 21. A retention material such as weld or cement is then placed at 32 to prevent removal or loosening of retention plug 30. Plug 30 has a reduced diameter section 33 contiguous to lubrication channel 18 to provide passage of lubricant around plug 30 and into the thrust bearing area 28.

FIG. 3*a* is an alternate embodiment of the cutter structure of FIG. 3 wherein the conical hard metal cutting elements 16 have been replaced by special cutting structures 16*a* which utilize a hard metal base comprising a sintered or cast tungsten carbide material in which is embedded a cutting point 16*b* made of a natural or synthetic gem material such as diamond or diamond substitute.

FIG. 4 is the axial end view of the cutter bit structure 10 illustrating the placement of the two cutters 14*a* and 14*b*. The center line of each cutter is offset as shown at 34 and 35 from the center A of bit 10.

It should be noted that for economy in drawing and brevity in the specification not all of the inserts 16 are illustrated in the figures. For instance, these conical-shaped inserts with generally cylindrical bases are shown spaced apart along the bottom section of cutter 14*a* but have been omitted for clarity and brevity along the top of the cutter. In actual construction, inserts 16 will be located entirely around the cutter surface in a spaced apart configuration.

Also, the cutter 14*b* in FIG. 1 and the cutters of FIGS. 2 and 4 have been drawn in schematic so that the rows of spaced-apart individual cutting elements are indicated by the smooth circumferential ridges. It should be remembered when construing this specification that these ridges are schematic only and that they truly represent rows of spaced apart individual cutting elements.

Figure 5:
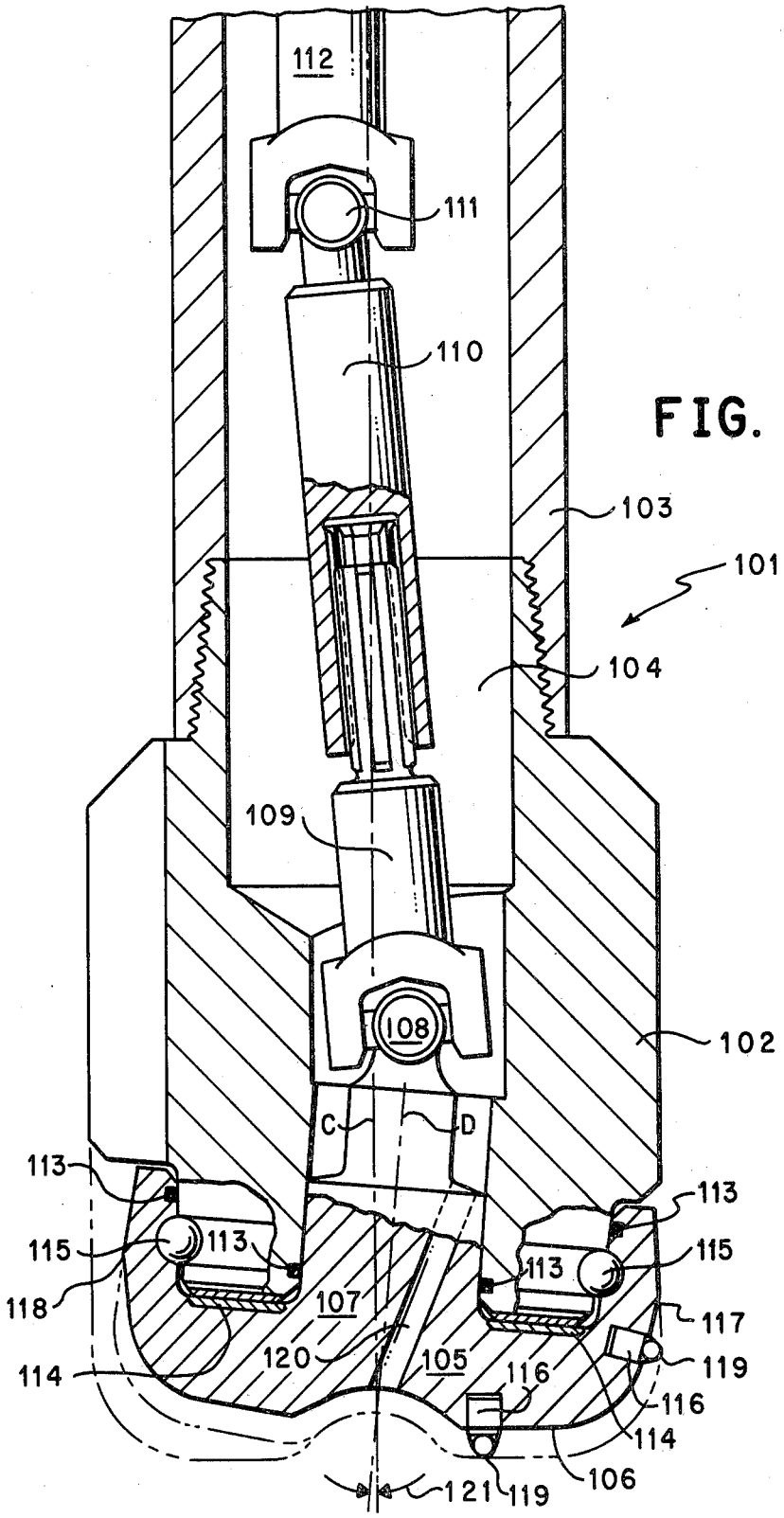
FIG. 5 is a sectional side view of a milling type drilling bit utilizing the present invention.
Figure 6:
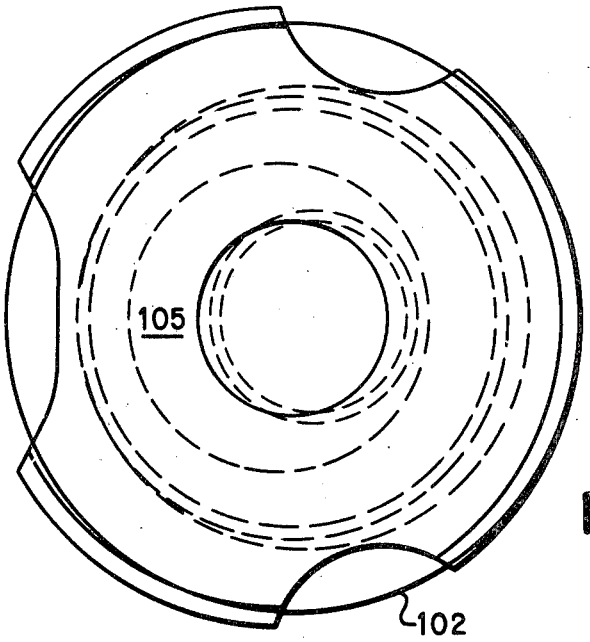
FIG. 6 is an axial end view of the bit of FIG. 5.

Referring now to FIG. 5, the second embodiment of the present invention is illustrated in full cross-sectional side view. In this embodiment a milling type drill bit is disclosed which provides an intermittent contact drilling operation. With this type of bit, drilling is accomplished by driving the milling cutter through a drive-shaft rotatably connected to a downhole motor, while slowly turning the bit with the drillpipe. The milling type drill bit 101 generally comprises a tubular body section or bit body 102 threadedly engaged in a tubluar housing 103. As shown in FIG. 6, the bit body 102 has a plurality of arcuate periphral portions that are so sized and shaped as to fit snuggly within the well bore and engage the side of the well bore for holding the drill bit stable within the well bore during drilling operations. Housing 103 and body section 102 have a contiguous inner bore passage 104 passing centrally therethrough. At the lower end of body 102 is a canted milling or cutter head 105 rotatably mounted in the bottom end of housing 102. Cutting head 105 comprises a cutter body 106 of generally circular section having a bottom and a side wall extending up from the bottom, and a central upwardly projecting drive axis 107. Drive axis 107 is connected by universal joint 108 to intermediate spline shaft 109 which in turn is splined into the upper spline shaft 110. Spline shaft 110 is connected by a universal joint 111 to internal drive shaft 112 of means, such as a downhole motor, for rotating the head 105. The joints 108,111 and the shafts 109,110 together constituting a linkage. The cutter head 105 is thus rotatable independently of the rotation of the bit body. Various seal means 113 prevent intrusion of corrosive and erosive matter into the bearing area of cutter head 105. The bearings between cutting head 105 and body 102 comprise flat friction type doughnut shaped thrust bearing 114 between the top side of cutter 105 and the lower end of body 102, comprising bearing surfaces lying in an inclined plane. Thrust bearings 114 may be of any known bearing material such as alloys of lead, tin, silver, indium, copper, cobalt, tungsten, stellite, etc. as is known to those skilled in the drill bit art. In addition to the flat friction type thrust bearing 114 there is also a set of ball bearings 115 utilized to retain cutter head 105 on body 102 and also to receive lateral forces on cutter head 105. A plurality of hard metal cutting elements 116 are embedded in the cutting face 106 of cutting head 105. The cutting elements 116 are located substantially over the face of head 105 from lateral edge 117 to the opposite edge 118. The cutting elements 116 preferably are made of a hard metal such as sintered tungsten carbide and contain a diamond or diamond substitute cutting tip 119 permanently embedded in the carbide body 116 and protruding outward for engagement in the formation material. Cooling is provided through the open areas of bore 104 and via passage 120 extending through cutter head 105. Cooling fluid is pumped down the tubing into cylinder 103 through bore 104 and passage 120 to the cutting face and passes around the cutting elements 116 and up the outside of body 102 back to the ground surface. The placement of cutter head 105 on body 102 is important and is located thereon in a canted relationship to provide intermittent contact of cutter elements 116 with the formation face. The axis of rotation D of the shaft 107 of cutter head 105 is canted at an angle alpha 121 with the central axis C of the drill stem. This canting of the axis of rotation of cutter 105 with the central axis of the drill bit provides one side of the cutter head in lower extension than the opposite side. Upon approaching a flat formation face this lower extending surface provides the earliest cutting element contact with the formation surface. By rotating the cutting head 105 inside of the drill bit body 102 while also rotating drill bit 102 by means of drill stem rotation provides contact or engagement of alternating cutting elements 116 at various times in the drilling operation. Thus no particular drilling element 116 will be in continuous contact with the formation being cut since the rotation of head 105 and body 102 serves to place one side of the cutting head in contact with the formation while the opposite side is lifted off of formation contact. This intermittent formation contact provides an opportunity for the non-contacting cutting elements 116 to receive adequate cooling from the cooling fluid passing through passage 120 during their non-contact phase.

Thus a prevention of the destructive build-up of heat in the cutting element is alleviated.

FIG. 6 is a schematic axial view of the drill bit of FIG. 5 showing the general configuration of the cutting head 105. The cutting elements 116 have been omitted to simplify the drawing and more clearly illustrate the cutting head overall shape.

Figure 9:
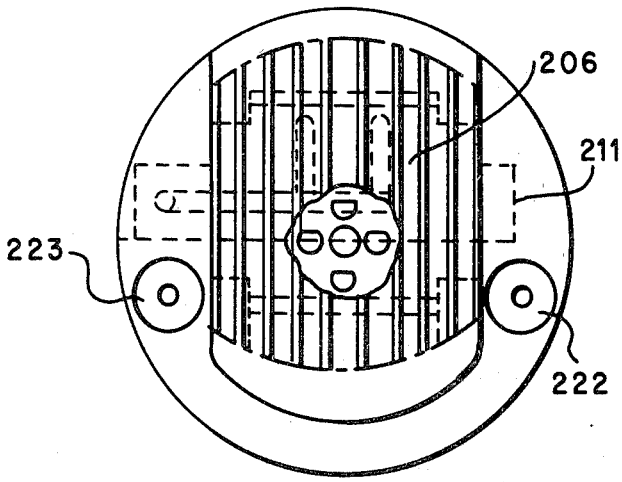
FIG. 9 is an axial end view of the bit of FIGS. 7 and 8.
Figure 7:
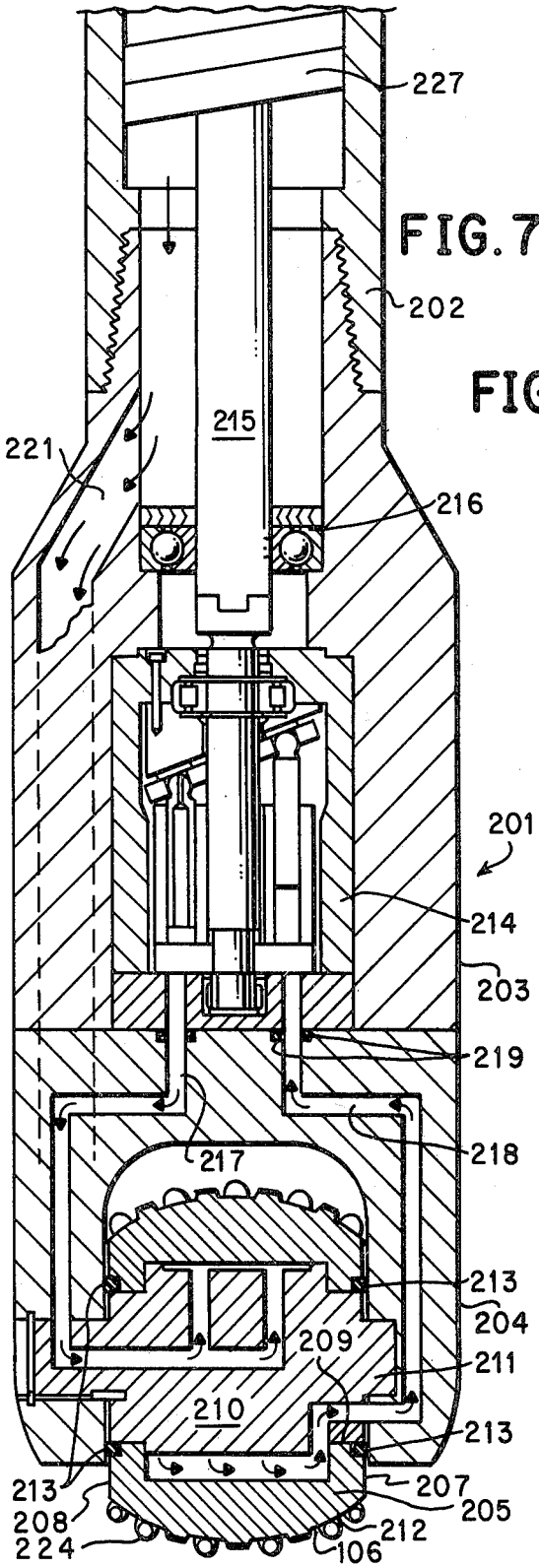
FIG. 7 is a sectional side view of a third embodiment of the invention which also utilizes a milling cutter.
Figure 8:
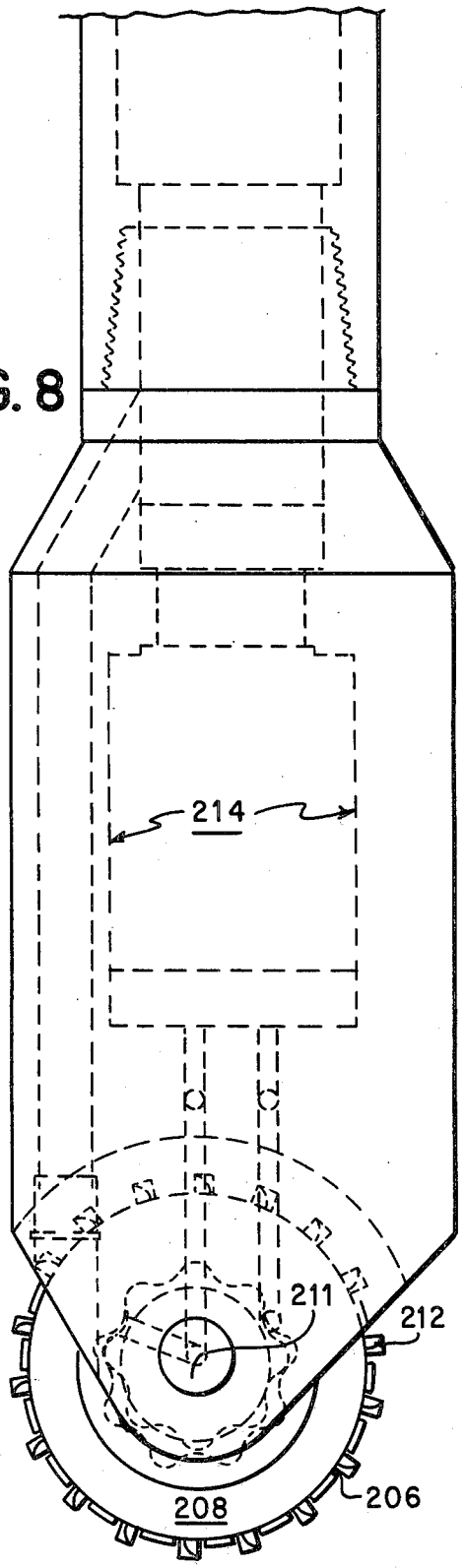
FIG. 8 is a side view of the bit of FIG. 7.

Referring now to FIGS. 7 through 9, the third embodiment of the invention is disclosed. In FIG. 7 another milling type drilling bit 201 is disclosed in cross-section side elevation. The drilling bit comprises an upper cylindrical structure 202, a main body housing 203, a cutter housing 204 and a rotatable cutter element 205. The rotatable cutter element 205 comprises a generally bulged cylinder having a partially spherical outer surface 206, relatively flat circular ends 207 and 208, and a longitudinal bore passage 209 passing therethrough. Cutter element 205 is mounted on a motor assembly 210 having a central shaft 211 which is permanently set in housing 204. The motor assembly 210 is attached to the cutter head 206 in such a manner that rotation of the electric or hydraulic motor 210 rotates cutter 206 about shaft 211 inside housing 204. As mentioned previously, motor assembly 210 can be of the type driven by hydraulic pressure or can be an electric motor. A plurality of cutting elements 212 are embedded or otherwise permanently affixed to the cutting surface 206 of cutting member 205. These cutting elements project outwardly from the curved surface 206 and are located in spaced apart relationship over substantially all of the curve surface 206. Circular seal means 213 are provided to protect the motor and cutter assembly from erosive or corrosive contaminants. Directly above the cutting assembly inside housing 203 is a drive assembly 214. This drive assembly may comprise a hydraulic pump as illustrated or alternatively could utilize an electric generator. Neither of these drive devices will be described in particular detail since both are readily available as off-the-shelf items to those skilled in the art. The power generator assembly 214 is connected to a drive shaft 215 by connection means 216 also well known in the art such as universal joints, spline shafts, flexible connections, etc. Directly above shaft 215 shown in schematic is a downhole motor 217 also well known and readily available in the industry. The downhole motor is of the common type which utilizes drilling fluid pumped downhole to convert part of the drilling fluid pressure into a rotary motion. Such downhole motors often use turbines or vanes to convert drilling fluid pressure into rotary motion. This rotary motion from the downhole motor 217 is transmitted via shaft 215 to the power means 214. In this illustrated embodiment the power means 214 converts the rotary motion into hydraulic pressure which is pumped through supply channel 217 to supply the hydraulic motor and convert the hydraulic pressure into rotary motion of the cutter wheel 205. Low pressure return fluid is transmitted through channel 218 back to the power generation means 214 to be recycled and repressurized during a later cycle. The entire hydraulic system 214 and 210 is a completely enclosed system and is protected from leakage by seals 219.

FIG. 8 illustrates a lateral side view of the drill bit of FIG. 7 rotated ninety degrees. The various components illustrated in the cross sectional configuration of FIG. 7 are drawn in on FIG. 8 in phantom. Likewise, FIG. 9 is an axial end view of the drill bit of FIG. 7 also having various components drawn in with phantom lines. The sketch of FIG. 9 is primarily schematic and omits various features such as inserts 212 to better illustrate the orientation of the major bit components.

OPERATION OF THE PREFERRED EMBODIMENTS

Referring again to FIGS. 1 through 4, operation of the first embodiment is as follows. The drill bit 10 is engaged in a drill string at the tapered threaded connection end 11 and lowered into the bore hole. Because of the bit geometry, the rotatably mounted cutters migrate slowly around their journals as the drillstem is turned. Each cutting element transcribes a spiral pattern across the hole bottom, cutting both the gage and along the hole bottom. Each cutting element comes into contact with the gage of the hole as it migrates in and out of contact with the hole bottom. The cutting and removal of the formation is accomplished by a scraping, dragging action of the cutting elements. The present drill bit differs from a true rolling cone bit in that the two rotating cutters 14 rotate very slowly around journals 15 compared to the rotational speed of the drill stem to which the bit is connected. This slow rotation of cutters 14 provides intermittent contact of varying sets of cutter elements 16 with the surface being drilled i.e. the formation face. This intermittent contact of the cutting element 16 allows the non-contacting elements to be rotated away from the cutting face, thereby achieving substantial cooling of the heat buildup in the cutting elements which arises as a result of the high drag forces created by the rotation of the bit. As a result of this tremendously increased cooling time and efficiency resulting from the intermittent contact feature of the present embodiment, particularly difficult to use cutting elements such as diamond tipped inserts and diamond studded inserts may be advantageously utilized herein. In FIG. 3*a* a typical installation of diamond tipped inserts is illustrated wherein the insert 16*a* comprises a hard metal material such as tungsten carbide in which is embedded a diamond chip 16*b* for gouging and scraping the rock face. The diamond chip 16*b* may be synthetic or natural. Other hard cutting gems such as YAG may be utilized in place of diamonds in this structure. As previously mentioned, the high heat buildup which occurs in diamond hard-metal cutting elements is effectively dissipated by the use of this intermittent contact, high drag drilling bit, thereby allowing the use of this bit in tough, highly abrasive formations without the usual deterioration and wear resulting from the heat buildup. A coolant such as drilling mud is normally circulated down the drill string through the center of bit 10 and out through the bottom of the bit through jet nozzles 36. This cooling fluid encircles and contact the cutting elements 16 as they are lifted off of the cutting face and rotated around through the non-contacting position. As a result, the heat buildup in each individual cutting element 16 is substantially removed by the cooling fluid during the non-contacting stage of the cutter rotation.

Referring now to FIGS. 5 and 6, the rotary milling type drill bit 101 is disclosed and its operation also provides the distinctive and advantageous intermittent contact drilling. In typical operation bit 101 is threadedly engaged in the lower end of a drilling string. The drill string has a turbo motor or drilling motor (not illustrated) located therein. The drilling motor may be of the type operated by the fluidic pressure of the drilling mud being circulated down the drill string. The rotation of the drilling motor drives the drive shaft 112 connected to the spline shaft 110 and the lower drive shaft 109. The canted milling head 105 is connected to shaft 109 at universal joint 108 so that as the drilling mud is circulated and the downhole motor (not shown) is driven, the interconnection of the drive shafts with the milling head serves to rotate the milling head in the housing 102. The rotation of the head 105 on the canted axis D—D brings the lowermost edge of the cutting head into closest proximity with the rock formation being drilled. The cutting elements 116 located on this lowermost edge of head 105 are brought into high drag contact with the rock face. If the drill string were not rotated, eventually the entire cutting face of head 105 would contact the face of the formation being drilled and a full face contact would occur. To prevent the full time contact of the cutting elements, the drill stem is rotated at a normal drilling speed while the cutting head 105 is concurrently being rotated inside of the drill stem. This serves to move the lowermost end of head 105 around the full diameter of the bore hole being cut in the formation. The rotation of the drill stem serves to move the lowermost projecting cutting elements around the bottom of the bore hole while concurrently the rotation of cutting head 105 serves to alternate the various cutting elements in contacting and then non-contacting configuration against the bottom of the bore hole. This compound rotational motion serves to introduce the high drag cutting forces needed in these tough abrasive formations while also giving the cooling and drilling configuration required to preserve the integrity of the cutting elements.

Drilling mud which has been circulated down the drill string to drive the downhole motor and to cool the bit and carry away the rock cuttings passes down through bore 104, around U-joint 108, and out through passage 120 to circulate around the cutting elements 116 and provide cooling to dissipate heat therein. It should also be noted that cutting elements 116 may have hard material inserts such as diamonds or synthetic diamonds 119 embedded therein to further resist the abrasive tendencies of the formation being drilled.

Referring now to FIGS. 7 through 9, operation of the third embodiment will be more particularly described. The third embodiment utilizes a milling type cutting bit which also employs the high drag principle for rapid drilling in tough abrasive formations. Likewise the present embodiment offers the intermittent contact techniques to greatly increase the total drilling time or drilling life of the cutting inserts 212. The third embodiment utilizes a similar or identical downhole drill stem motor (not shown) such as that utilized in the second embodiment. The downhole motor is illustrated by schematic block diagram at 227. This motor receives fluidic pressure from the circulated drilling mud being pumped down the drill string and converts the pressure into rotary motion which is transferred by upper shaft 215 into the power unit 214. As mentioned previously, the power unit 214 illustrates a hydraulic pump which receives the rotary motion and converts it into hydraulic pressure to supply the hydraulicly driven cutting wheel 206. Alternatively, the power unit 214 could be a rotary driven electric generator having leads extending to the cutting wheel 206 which in turn would be driven by an internal electric motor. In the embodiment illustrated though, a hydraulic system is utilized which is entirely enclosed and is resistant to contaminants from the formation and/or the drilling mud.

The high pressure drilling fluid being circulated down the string drives the downhole motor 227 which produces, as output, the rotation of shaft 215. Shaft 215 in turn drives the hydraulic pump 214 which supplies pressurized hydraulic fluid in the closed circuit through channel 217 to the hydraulic motor 210 having as its rotating portion the cutting wheel 206 which also serves as the motor housing. The result of the high pressure fluid from the hydraulic motor 214 is to supply rotary torque to cutting wheel 206 to drive it against the formation face concurrently as the drill bit and drill string are being rotated as in normal drilling operations. The rotation of the cutting head 206 brings the lowermost cutting elements 212 into high drag cutting relationship with the formation face. All other elements than those at the lowermost face are in non-contacting positions and are being cooled by the passage of the drilling fluid down the drill stem. After the drilling fluid has driven the downhole motor 227, it passes through the drill bit bore passage around shafts 215 and into the mud flow passages 221 which pass downward through the drill bit and exhaust in the area of the cutting wheel at 222 and 223. The present embodiment, just as in the previous embodiments, also is particularly advantageous for use with diamond embedded cutting elements 212. In the present invention the cutting elements 212 are illustrated in schematic as having embedded chips 224 composed of natural or synthetic diamonds or other hard gemlike material. Because of the intermittent contact resulting from the rotation of cutting wheel 206, these heat sensitive composite cutting elements are particularly advantageous for use in tough abrasive formations and do not suffer the normal heat deterioration and rapid wear.

SUMMARY

Thus, the present invention discloses methods and apparatus which are particularly advantageous over the prior art methods for high drag, long service drilling of tough, highly abrasive formations. The present embodiments provide high drag intermittent contact drilling techniques which result in rapid and efficient removal of the abrasive rock from the formation being drilled while allowing generous cooling of the heat sensitive, abrasion resistant cutting elements. This rapid and efficient cooling occurs because of the intermittent contact feature of the present embodiments. Thus, the method disclosed utilizes intermittent contact, high drag drilling bits which maintain the cutting elements in contact with the abrasive formation only a portion of the drilling cycle, and during the non-contact portion, allow circulation of cooling fluid around the cutting elements. The unique combination of high drag with intermittent contact and the abrasion-resistant heat-sensitive cutting elements provides a uniquely advantageous process for rapid and efficient removal of abrasive rock from underground formations.

The advantages of this invention are numerous and substantial. The invention allows the use of heat-sensitive, highly abrasive-resistant drilling elements such as diamond tip inserts in tough abrasive formations. These inserts provide rapid drilling rates but, as well known in the prior art, were very prone to deteriorate unless rapid and extensive cooling could be achieved around the cutting elements. Prior art methods utilized extremely high flow velocities in the drilling fluid to achieve this cooling around the continuous contact drilling elements. The present invention offers the tremendous advantage of introducing an intermittent contact drilling process whereby each individual cutting element is contacting the rock face only during a small portion of the cutting cycle. Another advantage is that the fluid flow rate required to achieve optimum cooling is only a small fraction of that required with the continuous contact drilling tools known in the industry. This great reduction in flow velocity of the coolant allows a more efficient drilling operation and less erosion of the internal parts of the equipment. Thus the major advantages are the extended life of the cutting elements, the rapid drilling rates achievable and the reduction in the required flow velocity of the drilling mud-coolant.

Although a specific preferred embodiment of the present invention has been described in the detailed description above, the description is not intended to limit the invention to the particular forms of embodiments disclosed therein since they are to be recognized as illustrative rather than restrictive and it will be obvious to those skilled in the art that the invention is not so limited. For example, whereas in the third embodiment the hydraulic power unit and the hydraulicly driven cutting head are disclosed, it would be easy for one skilled in the art to utilize an electrically driven cutting unit connected electrically to a power unit comprising an electric generator driven by the downhole motor. Likewise, whereas certain types of high drag bits are illustrated wherein intermittent contact of the cutting elements is achieved by rotation of the elements into and out of cutting engagement, it is also possible that using this disclosure, other embodiments utilizing intermittent contact can be designed by those skilled in the art. For instance, any normal milling cutter having a full contact drilling element could be modified to provide intermittent contact by providing a system of alternatively extending and retracting cutting elements on a cyclic basis. Thus, no single cutting element would be in continuous contact with the formation for any period of time to cause extended deterioration of the element. This cycling of the cutting elements from extended to retracted positions could be achieved by hydraulic, mechanical, or electrical means known to those in the art. Thus, the invention is declared to cover all changes and modifications of the specific example of the invention herein disclosed for purposes of illustration which do not constitute departure from the spirit and scope of the invention.

I claim:

1. A rotarty drill bit for drilling a well bore in a formation, the bit comprising:

a bit body having a threaded pin at its upper end adapted to be detachably secured to drill pipe or the like for rotating the bit body;

a cutter head rotatably mounted on the bit body at the bottom thereof, said cutter head comprising a cutter body of generally circular shape in transverse section having a bottom and a side wall extending up from the bottom, and a plurality of drag cutting elements mounted on and projecting from said bottom and side wall of the cutter body, with the cutting elements on the bottom of the cutter head being engageable with the bottom of the well bore and the cutting elements on the side wall being engageable with the side of the well bore, the cutter head being of slightly smaller overall diameter than the well bore and being mounted on the bit body with its axis of rotation at an angle relative to that of the bit body; and means for interconnecting the cutter head to means for rotating the cutter head relative to the bit body, with the cutter head thus being rotatable independently of the rotation of the bit body, whereby with the bit in a well bore and upon rotation of the bit body and rotation of the cutter head relative to the bit body, each cutting element intermittently engages the formation, with only a predetermined number of the cutting elements engaging the formation at any one point in time, but with all cutting elements engaging the formation over a predetermined period of time, for enabling improved cooling of the cutting elements for extended cutting element life.

2. A rotary drill bit as set forth in claim 1 wherein the bit body is a generally tubular member and is adapted to receive drilling fluid under pressure from the passage in the drill pipe, and wherein the cutter head has passaging therein for flow of the drilling fluid down from the bit body to the underside of the cutter head.

3. A rotary drill bit as set forth in claim 1 wherein the angle between the axes of rotation of the bit body and the cutter head is at least approximately 2 degrees.

4. A rotary drill bit as set forth in claim 1 wherein each cutting element comprises an elongate member of tungsten carbide mounted on and projecting from the cutter body and a generally planar member of diamond mounted on the projecting portion of the elongate member.

5. A rotary drill bit as set forth in claim 1 wherein said interconnecting means comprises a mechanical linkage.

6. A rotary drill bit as set forth in claim 1 wherein said bit body is so sized and shaped as to fit snuggly within the well bore and engage the side of the well bore at spaced intervals around the bit body for holding the drill bit stable within the well bore during drilling operations.

7. A rotary drill bit as set forth in claim 1 further comprising bearing means for rotatably mounting the cutter head on the bit body, the bearing means comprising bearing surfaces lying generally in parallel inclined planes.

* * * * *